US011806962B2

(12) United States Patent
Galkin

(10) Patent No.: US 11,806,962 B2
(45) Date of Patent: Nov. 7, 2023

(54) METHOD AND APPARATUS TO CONTROL HEAT PRESS

(71) Applicant: Stahls' Inc., Sterling Heights, MI (US)

(72) Inventor: Anton Galkin, Sterling Heights, MI (US)

(73) Assignee: STAHLS' INC., St. Clair Shores, MI (US)

( * ) Notice: Subject to any disclaimer, the term of this patent is extended or adjusted under 35 U.S.C. 154(b) by 22 days.

(21) Appl. No.: 17/392,882

(22) Filed: Aug. 3, 2021

(65) Prior Publication Data

US 2023/0038436 A1 Feb. 9, 2023

(51) Int. Cl.

| | |
|---|---|
| ***B30B 1/04*** | (2006.01) |
| ***B30B 15/06*** | (2006.01) |
| *B41F 16/02* | (2006.01) |
| *B41F 33/00* | (2006.01) |

(52) U.S. Cl.

CPC ..... *B30B 15/064* (2013.01); *B30B 1/04* (2013.01); *B41F 16/02* (2013.01); *B41F 33/0009* (2013.01)

(58) Field of Classification Search

CPC .... B30B 1/02; B30B 1/04; B30B 1/10; B30B 1/12; B30B 15/062; B30B 15/064; B30B 15/34; B41F 16/0046; B41F 16/02

See application file for complete search history.

(56) References Cited

U.S. PATENT DOCUMENTS

| | | | | |
|---|---|---|---|---|
| 5,252,171 | A * | 10/1993 | Anderson | B30B 1/12 156/359 |
| 5,435,883 | A * | 7/1995 | Myers | B41F 16/02 156/583.9 |
| 5,474,633 | A * | 12/1995 | Myers | B41F 16/00 156/583.8 |
| 5,769,999 | A * | 6/1998 | Anderson | B29C 65/18 100/319 |
| 9,596,899 | B2 | 3/2017 | Stahl et al. | |
| 10,463,113 | B2 | 11/2019 | Manz et al. | |
| 2007/0084547 | A1 | 4/2007 | Lane | |
| 2009/0242096 | A1 | 10/2009 | Robinson | |
| 2011/0076079 | A1 | 3/2011 | Robinson | |
| 2014/0238600 | A1 | 8/2014 | Mahn | |
| 2018/0325312 | A1 | 11/2018 | Moon | |
| 2022/0040947 | A1* | 2/2022 | Mombourquette | B30B 1/04 |

OTHER PUBLICATIONS

Extended European Search Report dated Dec. 12, 2022 for copending European App. No. EP2218.

* cited by examiner

*Primary Examiner* — Matthew Katcoff
(74) *Attorney, Agent, or Firm* — Fishman Stewart PLLC

(57) ABSTRACT

A heat press includes a base, a handle, a controller, a heater arm, a pressure link, a lower platen, and an upper platen. The handle is pivotally coupled to the base. The controller is integrally formed with the handle. The heater arm is pivotally coupled to the base. The pressure link is pivotally coupled to the handle and the heater arm. The lower platen is connected to base. The upper platen is connected to the heater arm. A surface of the upper platen is separated from a surface of the lower platen in a first position, and the surface of the upper platen is in contact with the surface of the lower platen in a second position.

17 Claims, 5 Drawing Sheets

METHOD AND APPARATUS TO CONTROL HEAT PRESS

TECHNICAL FIELD

The exemplary illustrations described herein are generally directed to presses, such as heat transfer presses that include platens.

BACKGROUND

Heat applied transfers include a variety of indicia with inks, material layers, and adhesives that become bonded to material layers, for example, apparel such as shirts, jackets, or the like, upon pressurized contact and heating of the transfers and apparel between press platens. Graphic images and lettering may generally be accurately and quickly transferred to the apparel without bleeding or partial interruptions in the bonding of the transfer, as long as the presses can be operated at a predetermined temperature for a predetermined time and at a predetermined pressure.

The presses typically accommodate many variations in the arrangement of transfers and apparel, as well as the types of transfers and apparel materials available. Moreover, the presses accommodate a wide variety of temperatures, pressures, and time intervals associated with application of indicia to a garment. Due to the desire for flexibility and economic factors, presses have traditionally been manually operated, i.e., they often rely on a user (e.g., an operator) to control at least (a) the force applied through the platens and (b) the length of time the force is applied with a mechanical apparatus.

The accuracy and precision of the temperature, and the pressure and the time duration for which these parameters are applied to the transfers, are particularly important to complete an efficient bonding of the transfers to materials and can be difficult to accomplish in an accurate and repeatable manner. The foregoing parameters are set and/or controlled via a heat press controller. Often, the heat press controllers are not viewable by the user during certain portions of the heat transfer process. For example, the user's view of the heat press controller may be blocked by a portion of the heat press when the heat press is opened and/or closed, which can not only be inconvenient to the operator, but may result in errant settings being applied and can result in lost or wasted product. Accordingly, there remains a need for an improved heat press.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description.

DETAILED DESCRIPTION

Figure 1:
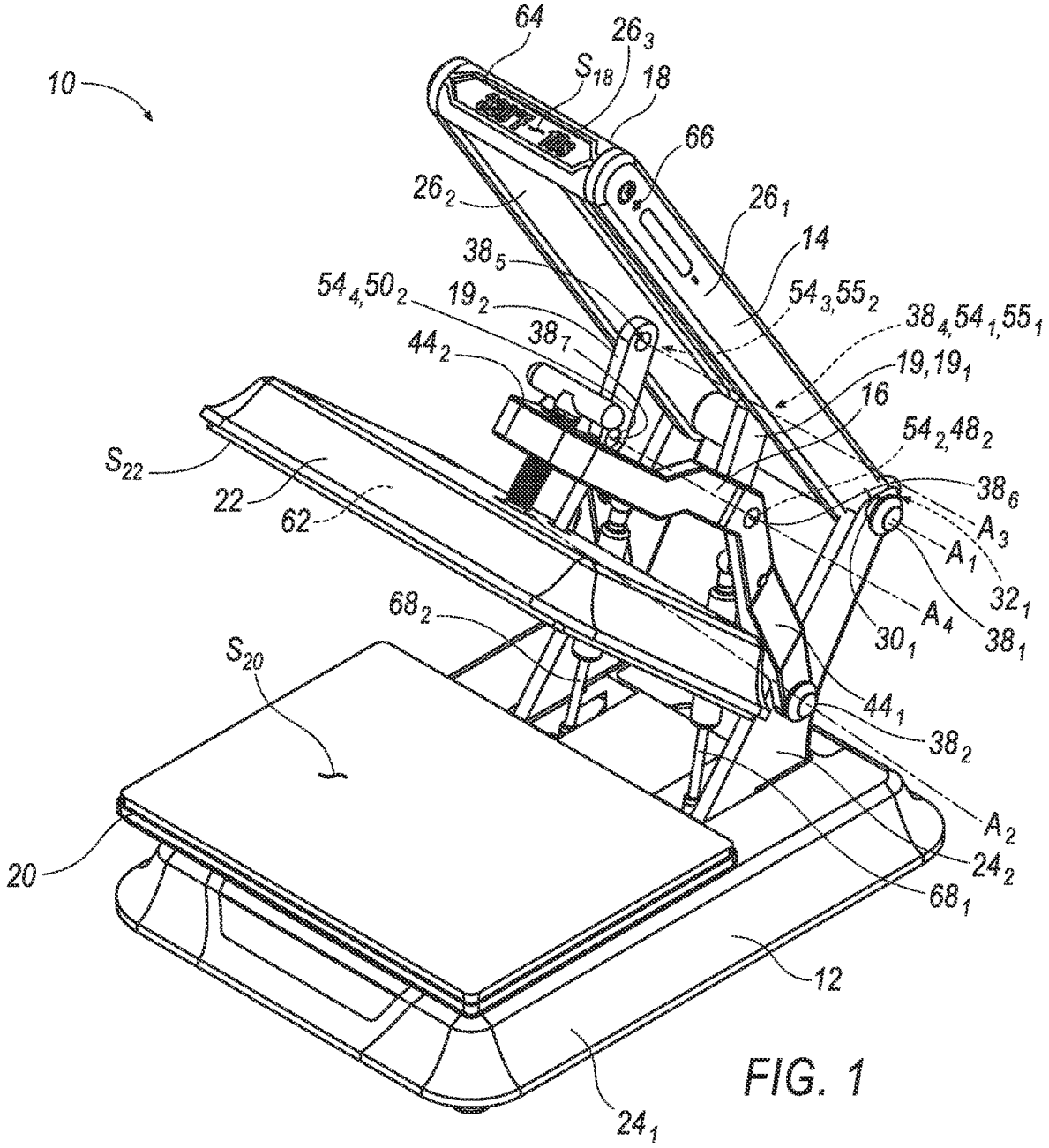
FIG. 1 illustrates a perspective view of an exemplary press in an open position.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Various exemplary illustrations are provided herein of exemplary presses, e.g., for applying indicia to garments by application of heat. According to one exemplary illustration, a press may include an upper platen, and a lower platen disposed below and generally aligned with the upper platen. The press may be adapted to move the upper platen between an open position, wherein the upper and lower platens are spaced away from one another, and a closed position, wherein the upper platen is pressed against the lower platen A heat press may include a base, a handle, a controller, a heater arm, a pressure link, a lower platen, and an upper platen. The handle may be pivotally coupled to the base. The controller may be integrally formed with the handle. The heater arm may be pivotally coupled to the base. The pressure link may be pivotally coupled to the handle and the heater arm. The lower platen may be connected to base. The upper platen may be connected to the heater arm. A surface of the upper platen may be separated from a surface of the lower platen in a first position. The surface of the upper platen may be in contact with the surface of the lower platen in a second position Exemplary illustrations are described in detail below. General discussion applies to all the figures as follows, with discussion specific to each figure later provided.

Referring generally to the figures, an exemplary heat press 10 is shown according to the disclosure. The heat press 10 may include a base 12, a handle 14, a heater arm 16, a controller 18, a pressure link 19, a lower platen 20, and/or an upper platen 22. In some example configurations, the base 12 may include a first portion $\mathbf{24}_1$, a second portion $\mathbf{24}_2$, and/or a third portion $\mathbf{24}_3$. The second portion $\mathbf{24}_2$ and/or the third portion $\mathbf{24}_3$ may extend from the first portion $\mathbf{24}_1$. The second portion $\mathbf{24}_2$ may be spaced apart from the third portion $\mathbf{24}_3$. In some examples, the second portion $\mathbf{24}_2$ and the third portion $\mathbf{24}_3$ may include geometries (e.g., shapes) that are substantially similar.

In some example configurations, the handle 14 may be pivotally coupled to the base 12. In some examples, the handle 14 may include a first portion $\mathbf{26}_1$ spaced apart from a second portion $\mathbf{26}_2$, and/or a third portion $\mathbf{26}_3$ extending between and/or connecting the first portion $\mathbf{26}_1$ and the second portion $\mathbf{26}_2$. In some instances, the first portion $\mathbf{26}_1$ and the second portion $\mathbf{26}_2$ may include geometries that are substantially similar (e.g., elongated). In some examples, the first portion $\mathbf{26}_1$ of the handle 14 may be pivotally coupled to the second portion $\mathbf{24}_2$ of the base 12 and/or the second portion $26_2$ of the handle 14 may be pivotally coupled to the third portion $24_3$ of the base 12.

In some examples, the first portion $26_1$ of handle 14 may include a through hole $30_1$ that may be aligned with a through hole $32_1$ of the second portion $24_2$ of the base 12 and/or the second portion $26_2$ of handle 14 may include a through hole $34_1$, that may be aligned with a through hole $36_1$ of the third portion $24_3$ of the base 12. In some examples, a first coupler $38_1$ including a bolt 40 (e.g., a pin, a rod, a screw, among others) and at least one fastener 42 (e.g., a nut, etc.) may be disposed, at least partially, within the through holes $30_1$, $32_1$. In some example configurations, the first coupler $38_1$ may be configured to, at least in part, pivotally couple the handle 14 to the base 12, such that the handle 14 rotates relative to the base 12 about a first axis A1.

In some example configurations, the controller 18 may be integrally formed with the handle 14, and in the illustrated example is on an end of the handle 14. In some instances, the controller 18 may be disposed within the third portion $26_3$ of the handle 14. In some examples, the controller 18 may be at least partially disposed in the first portion $26_1$, the second portion $26_2$, and/or the third portion $26_3$ of the handle 14. In some examples, the third portion $26_3$ of the handle 14 includes the controller 18.

In some implementations, the heater arm 16 may be pivotally coupled to the base 12. The heater arm 16 may include a first portion $44_1$ and/or a second portion $44_2$. The first portion $44_1$ and the second portion $44_2$ may include substantially similar geometries. In some examples, the first portion $44_1$ of the heater arm 16 may be pivotally coupled to the second portion $24_2$ of the base 12 and/or the second portion $44_2$ of the heater arm 16 may be pivotally coupled to the third portion $24_3$ of the base 12.

In this regard, the first portion $44_1$ of the heater arm 16 may include a first clevis $46_1$ and/or the second portion $44_2$ of the heater arm 16 may include a second clevis $46_2$. The second portion $24_2$ of the base may be at least partially disposed with the first clevis $46_1$, such that portions of the first portion $44_1$ of the heater arm 16 may be disposed on either side of the second portion $24_2$ of the base 12. The third portion $24_3$ of the base 12 may be at least partially disposed within the second clevis $46_2$, such that portions of the second portion $44_2$ of the heater arm 16 may be disposed on either side of the third portion $24_3$ of the base 12.

In some examples, the first portion $44_1$ of the heater arm 16 may include a through hole $48_1$ that be aligned with an additional through hole $32_2$ of the second portion $24_2$ of the base 12 and/or the second portion $44_2$ of heater arm 16 may include a through hole $50_1$, that may be aligned with an additional through hole $36_2$ of the third portion $24_3$ of the base 12. In some examples, a second coupler $38_2$ may be disposed, at least partially, within the through holes $48_1$, $32_2$, and/or the first clevis $46_1$. A third coupler $38_3$ may be disposed, at least partially, within the through holes $50_1$, $36_2$, and/or the second clevis $46_2$. In some example configurations, the second coupler $38_2$ and/or the third coupler $38_3$ may be configured to, at least in part, pivotally couple the heater arm 16 to the base 12, such that the heater arm 16 rotates relative to the base 12 about a second axis A2. In some instances, the second axis A2 may extend in a direction that may be substantially parallel to the first axis A1.

In some example configurations, the pressure link 19 may be pivotally coupled to the handle 14 and/or the heater arm 16. In some examples, the heat press 10 may include a first pressure link $19_1$ and/or a second pressure link $19_2$. The first pressure link $19_1$ may be coupled to the first portion $44_1$ of the heater arm 16 and the second portion $24_2$ of the base. The second pressure link $19_2$ may be coupled to the second portion $44_2$ of the heater arm 16 and the third portion $24_3$ of the base.

In some implementations, the first pressure link $19_1$ may include a first through hole $54_1$ and a second through hole $54_2$, and/or the second pressure link $19_2$ may include a third through hole $54_3$ and a fourth through hole $54_4$. In some instances, the first through hole $54_1$ of the first pressure link $19_1$ may be aligned with an aperture $55_1$ of the first portion $26_1$ of the handle 14, and/or the third through hole $54_3$ of the second pressure link $19_2$ may be aligned with a second aperture $55_2$ of the second portion $26_2$ of the handle 14. In some examples, a fourth coupler $38_4$ (e.g., a bolt, a screw, a pin, a rod, among others) may be disposed, at least partially, within the first through hole $54_1$, and the first aperture $55_1$, and/or a fifth coupler $38_5$ (e.g., a bolt, a screw, a pin, a rod, among others) may be disposed, at least partially within the third through hole $54_3$, and the second aperture $55_2$.

In some implementations, the second through hole $54_2$ of the first pressure link $19_1$ may be aligned with an additional through hole $48_2$ of the first portion $44_1$ of the heater arm 16, and/or the fourth through hole $54_4$ of the second pressure link $19_2$ may be aligned with an additional through hole $50_2$ of the second portion $44_2$ of the heater arm 16. In some examples, a sixth coupler $38_6$ may be disposed, at least partially, within the through holes $54_2$, $48_2$, and/or a seventh coupler $38_7$ may be disposed, at least partially within the through holes $54_4$, $50_2$.

In some example configurations, the fourth coupler $38_4$ and/or the fifth coupler $38_5$ may be configured to, at least in part, pivotally couple the first pressure link $19_1$ and/or the second pressure link $19_2$ to the handle 14, such that the first pressure link $19_1$ and/or the second pressure link $19_2$ rotate about a third axis A3. The sixth coupler $38_6$ and/or the seventh coupler $38_7$ may be configured to, at least in part, pivotally couple the first pressure link $19_1$ and/or the second link $19_2$ to the heater arm 16, such that the first pressure link $19_1$ and/or the second link $19_2$ rotates about a fourth axis A4. In some instances, the first axis A1, the second axis A2, the third axis A3, and/or the fourth axis A4 may extend in directions that are substantially parallel. In some examples, the heater arm 16 may be coupled to the handle 14 via the pressure link 19.

In some implementations, the lower platen 20 may be fixed directly (e.g., screwed, fastened, etc.) to the base 12. In some instances, the lower platen 20 may be fixed directly to the first portion $24_1$ of the base 12. In some example configurations, the upper platen 22 may be coupled to the heater arm 16. In some instances, the upper platen 22 may be coupled to the heater arm 16 via an adjustment component 56. The adjustment component 56 may include a threaded portion 58 connected to a handle 60. The adjustment component 56 may be configured to move the upper platen 22 closer to and/or further away from the heater arm 16. In this regard, an operator of the heat press 10 may rotate the handle 60 about a fifth axis A5 which may move the upper platen 22 relative to the heater arm 16 (see, e.g., FIG. 2).

In some example configurations, a heater 62 may be disposed within at least one of the lower platen 20 and/or the upper platen 22. In some examples, the heater 62 may be disposed within the upper platen 22. In some examples, the heater 62 may be disposed within the lower platen 20. In some instances, the heater 62 may include conventional electrically resistive heating elements and the like, which may be formed as serpentine or otherwise wound throughout surface areas of the upper platen 22 and/or the lower platen 22.

The heater 62 may be coupled to a typical power supply (not depicted) through a switch and/or a controller and may be configured for adjusting the temperature of heater 62, e.g., by way of the controller 18. The temperature of the heater 62 may be adjusted by adjusting power to the heat elements. In some instances, the upper platen 22 and/or the lower platen 20 may carry a thermo-couple sensor, RTD probe, NTC thermistor or similar device (not shown) which may be wired in a conventional manner to generate temperature information for the controller 18, which displays information (e.g., heat press parameters) via a display 64 and/or a controller readout. The display 64 may be disposed on a viewing surface $S_{18}$ of the controller 18, such that the display 64 is viewable by an operator (e.g., a user) of the heat press 10. An electrical circuit for the heater 62 may also include a temperature control such as a thermostat.

In some implementations, the controller 18 may generally include computational and/or control elements (e.g., a microprocessor and/or a microcontroller). The controller 18 may be electrically connected to the heater 62. The controller 18 may generally provide time monitoring, temperature monitoring, pressure monitoring, and control, as examples. The display 64 of the controller 18 may further include various readout displays, e.g., to allow display of a force, temperature, or time associated with operation of the heat press 10. In some examples, the display 64 may allow for manipulation of the controller 18 by an operator, e.g., by way of a touchscreen interface (not shown). In some examples, the controller 18 may include input capabilities, to set time, temperature, and the like, via for instance, a touch screen, via push buttons 66, and/or turn knobs 67 as examples (see, e.g., FIGS. 5 and 6).

In some example configurations, the controller 18 may include a display 64 and at least one turn knob 67. In some instances, the controller 18 may include one or more additional displays 64. In some examples, the controller 18 may include a viewing surface $S_{18}$. The display 64 and the one or more additional displays 64 may be disposed on the viewing surface $S_{18}$. In some examples, each respective display 64 may be configured to display a different heat press parameter (e.g., a temperature of the heater 62 and/or a timer) (see, e.g., FIG. 5).

In some example configurations, the controller 18 includes a plurality of push buttons 66 that may be disposed on the viewing surface $S_{18}$ of the controller 18. In this regard, the push buttons 66 may be disposed on the same surface (e.g., the viewing surface $S_{18}$) as the display 64 and/or the one or more additional displays 64 (see, e.g., FIG. 6). In some example configurations, the display 64 may be on a different surface and/or disposed on a different portion of the handle 14 than the push buttons 66 and/or the turn knobs 67. For example, in some instances, the display 64 may be disposed on the third portion $\mathbf{26}_3$ of the handle 14, and the push buttons 66 and/or the turn knobs 67 may be disposed on the first portion $\mathbf{26}_1$ or the second portion $\mathbf{26}_2$ of the handle 14 (see, e.g., FIGS. 1-4).

In some instances, the heat press 10 may include a first shock $\mathbf{68}_1$ and/or a second shock $\mathbf{68}_2$. In some examples, the first shock $\mathbf{68}_1$ and/or the second shock $\mathbf{68}_2$ may be connected to the base 12 and the heater arm 16. In this regard, the first shock $\mathbf{68}_1$ may be connected to the second portion $\mathbf{26}_2$ of the base 12 and the first portion $\mathbf{44}_1$ of the heater arm, and/or the second shock $\mathbf{68}_2$ may be connected to the third portion $\mathbf{26}_3$ of the base 12 and the second portion $\mathbf{44}_2$ of the heater arm 16. The first shock $\mathbf{68}_1$ and/or the second shock $\mathbf{68}_2$ may be configured to counterbalance (e.g., dampen the movement of) the upper platen 22 (e.g., when the upper platen 22 includes the weight of the heater 62) when the operator manipulates the handle 14 to move the upper platen 22. The first shock $\mathbf{68}_1$ and/or the second shock $\mathbf{68}_2$ may include gas springs and/or other conventional shocks.

Figure 2:
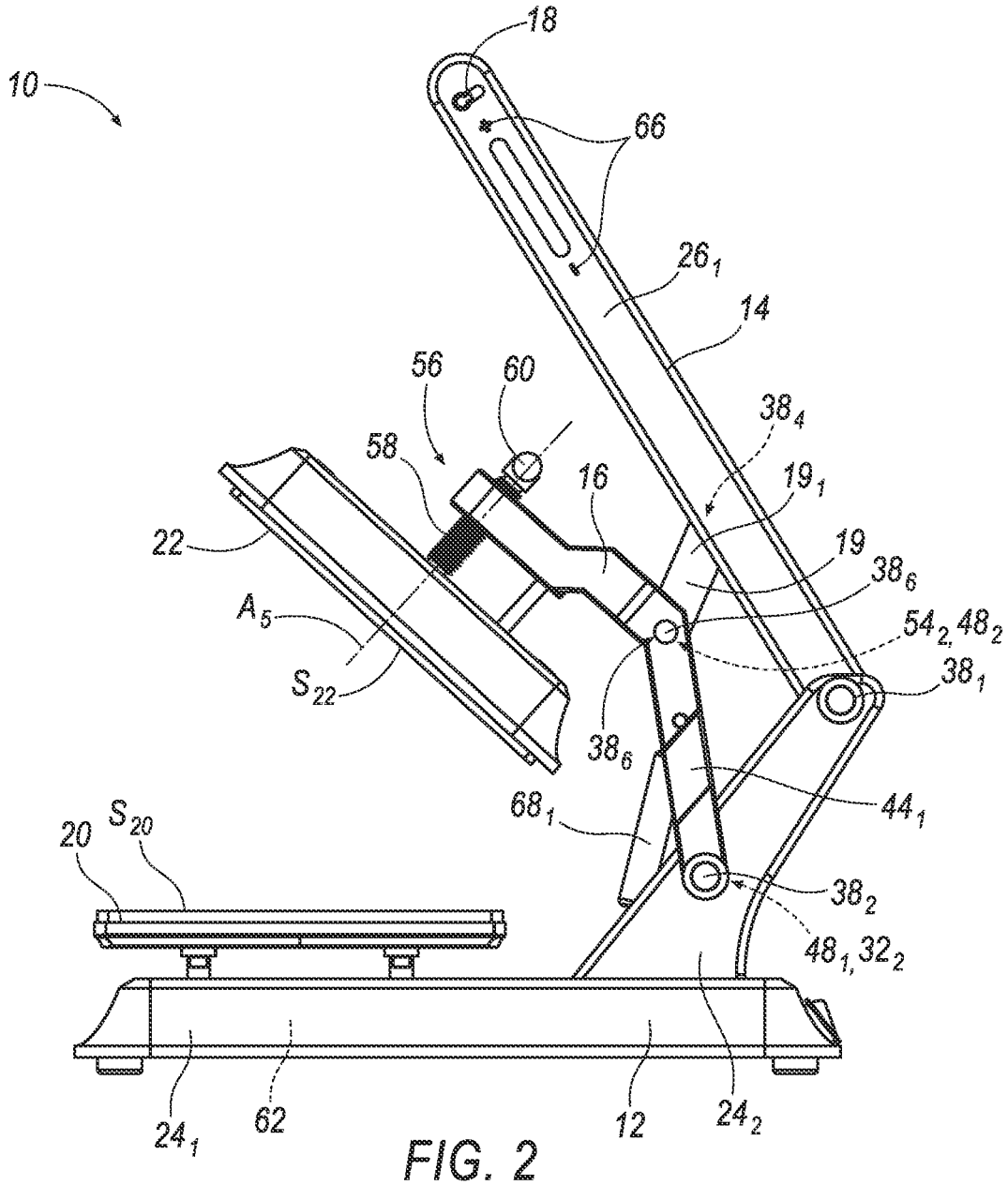
FIG. 2 illustrates a side view of an exemplary press in an open position.

Referring now to FIGS. 1-2, the heat press 10 is shown in an open position. When the heat press 10 is in the open position, an engagement surface $S_{22}$ of the upper platen 22 may be separated from an engagement surface $S_{20}$ of the lower platen 20. In some examples, when the heat press 10 is in the open position, an operator's view of the controller 18 is unobstructed. For example, the viewing surface $S_{18}$ of the controller 18 is not block by any components of the heat press 10.

Figure 3:
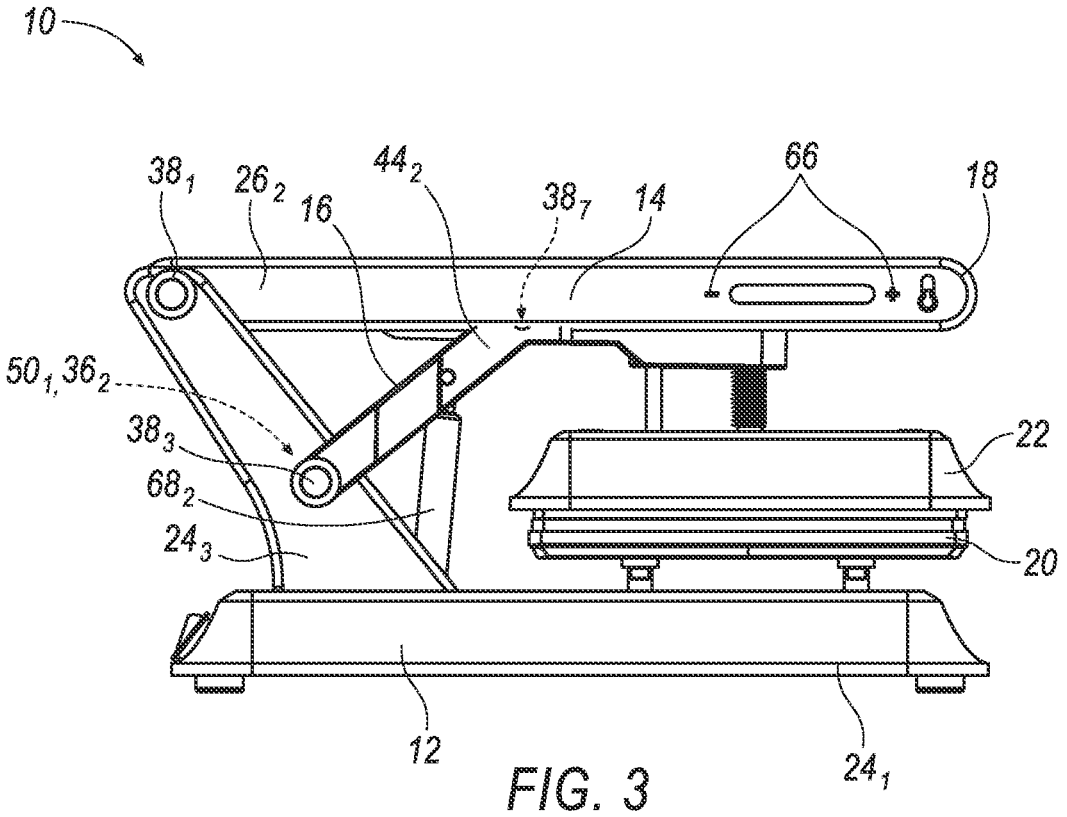
FIG. 3 illustrates a side view of an exemplary press in a closed position.
Figure 4:
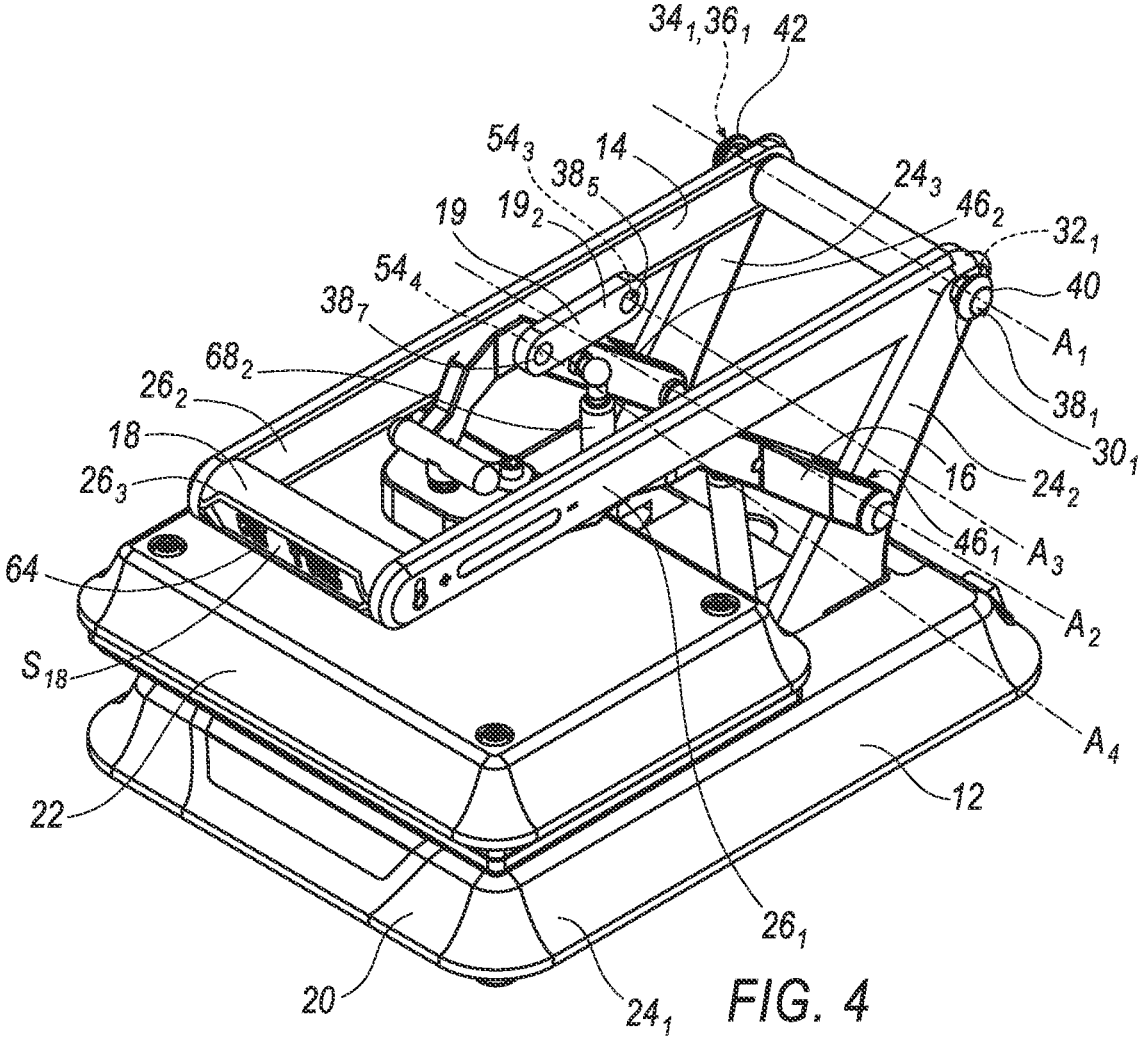
FIG. 4 illustrates a perspective view of an exemplary press in a closed position.
Figure 5:
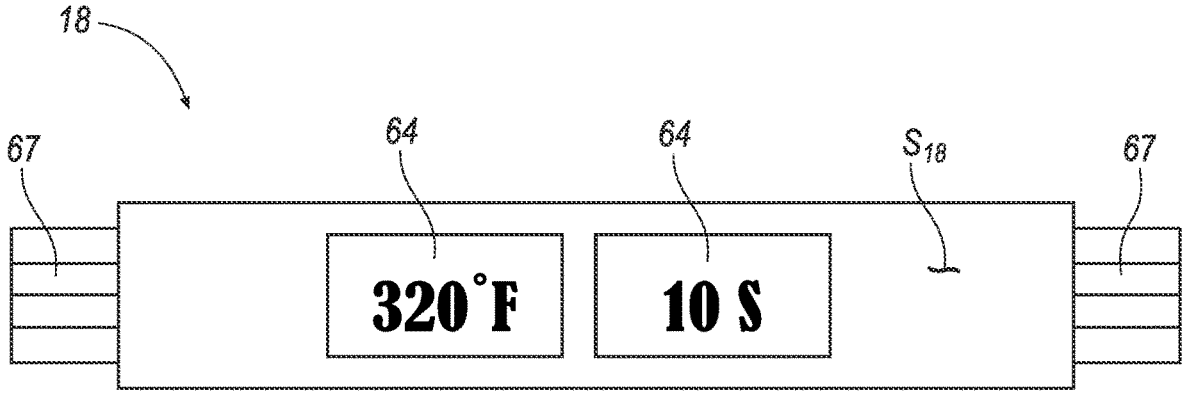
FIG. 5 illustrates an exemplary controller for a heat press.
Figure 6:
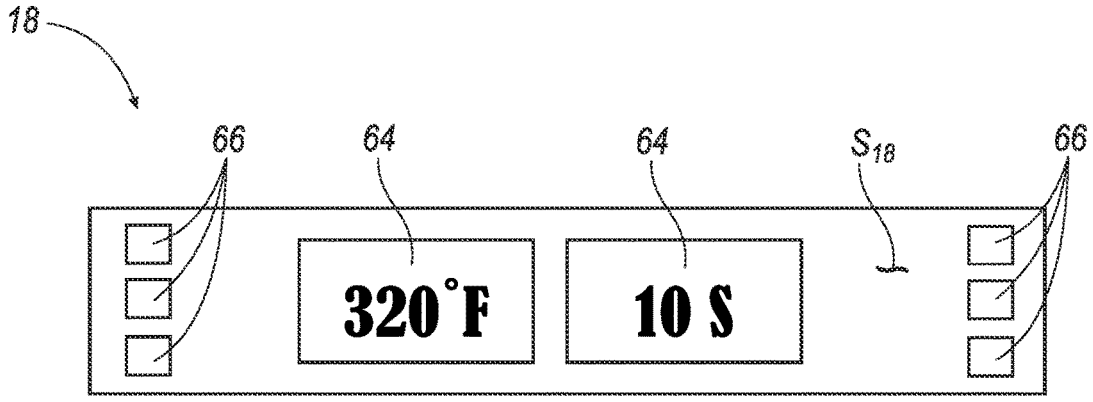
FIG. 6 illustrates another exemplary controller for a heat press.

Referring now to FIGS. 3-5, the heat press 10 is shown in a closed position (e.g., a second position). In the closed position, the engagement surface $S_{22}$ of the upper platen 22 may be in contact with (e.g., engage) the engagement surface $S_{20}$ of the lower platen 20. In some examples, when the heat press 10 is in the closed position, an operator's view of the controller 18 is unobstructed. For example, the viewing surface $S_{18}$ of the controller 18 is not block by any components of the heat press 10.

During operation, manipulation (e.g., movement) of the handle 14 (e.g., a terminal end of the handle 14 and/or the third portion $\mathbf{26}_3$ of the handle 14) may cause the pressure link 19 (e.g., a first press link $\mathbf{19}_1$ and/or a second pressure link $\mathbf{19}_2$), the heater arm 16, and/or the upper platen 22 to simultaneous move. In this regard, when the operator manipulates the handle 14, the handle 14 will rotate relative to the base 12 about the first axis A1. The pressure link 19 will rotate relative to the handle 14 about the third axis A3, and/or the pressure 19 will rotate relative to the heater arm 16 about the fourth axis A4. The heater arm 16 will rotate relative to the base 12 about the second axis A2, which may cause the upper platen 22 to move relative to the lower platen 20.

In some implementation, during operation of the heat press 10, an operator's view and/or access to the controller 18, the display 64, the push buttons 66, and/or the turn knobs 67 are never blocked/obstructed. For example, the controller 18 is formed integrally with the handle 14 (e.g., a terminal end of the handle 14 and/or the third portion $\mathbf{26}_3$ of the handle 14). In this regard, the operator of the heat press 10 engages (e.g., grabs, contacts, etc.) the terminal end of the handle 14 and/or the third portion $\mathbf{26}_3$ of the handle 14 throughout the entire heat transfer process. Therefore, by integrally forming the controller 18 with the handle 14, the operator has easy (e.g., unblock/unobstructed) access to the controller 18, the display 64, the push buttons 66, and/or the turn knobs 67 throughout the entire heat transfer process.

In some example configurations, the heat press 10 may include a low profile. As such, the heat press 10 may be able to operate in a variety of tight environments due to its low profile. The disclosed subject matter therefore includes minimal gap between the upper platen 22 (e.g., when the heater 62 is disposed within the upper platen 22) and the heater arm 16 (e.g., all the compliance structure is under the platen 22 where more space for garment clearance is beneficial, instead of above the heater 62). The handle 14 positions maintain low profile (i.e., the handle 14 does not stick straight up making it more difficult to store).

In some examples, the heat press 10 may include a total height of approximately 9", a width of approximately 13", a depth of approximately 18", a platen height of approximately 4", and a clearance around the platen of approximately 2". This is in contrast to known heat presses that occupy a larger profile or volume (e.g., bulky) and are generally much taller. The low profile or volume is obtained due to, at least in part, the compact nature of engagement of the base 12 with the lower platen 20. In addition, the overall package height is minimized due to the additional impact of the handle 14 and its operation to raise and lower the upper platen 22.

Thus, the conditions for setup, takedown, and operation in cramped and inconvenient locations is improved because of the compact design.

Thus, according to the disclosure and as illustrated in the drawings, a heat press 10 includes a base 12, a handle 14 pivotally coupled to the base 12, a controller 18 integrally formed with the handle 14, a heater arm 16 pivotally coupled to the base 12, and a pressure link 19 pivotally coupled to the handle 14 and the heater arm 16. Heat press 10 further includes a lower platen 20 connected to the base 12, and an upper platen 22 connected to the heater arm 16. A surface $S_{22}$ of the upper platen 22 is in contact with a surface $S_{20}$ of the lower platen 20 in a first position, and the surface $S_{22}$ of the upper platen 22 is separated from the surface $S_{20}$ of the lower platen 20 in a second position.

Additionally, according to the disclosure, and as illustrated in the drawings, a method of fabricating a heat press 10 includes integrally forming a controller 18 with a handle 14, attaching the handle 14 to a base 12, attaching a heater arm 16 to the base 12, coupling a pressure link 19 to the heater arm 16 and the handle 14, attaching a lower platen 20 to the base 12, and coupling an upper platen 22 to the heater arm 16.

The exemplary illustrations are not limited to the previously described examples. Rather, a plurality of variants and modifications are possible, which also make use of the ideas of the exemplary illustrations and therefore fall within the protective scope. Accordingly, it is to be understood that the above description is intended to be illustrative and not restrictive.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

What is claimed is:

1. A heat press comprises:
- a base;
- a handle pivotally coupled to the base;
- a controller disposed at least partially in the handle;
- a heater arm pivotally coupled to the base;
- a pressure link pivotally coupled to the handle and the heater arm;
- a lower platen connected to the base; and
- an upper platen connected to the heater arm;
- wherein a surface of the upper platen is in contact with a surface of the lower platen in a first position; and
- the surface of the upper platen is separated from the surface of the lower platen in a second position;
- wherein the handle includes:
  - a first portion pivotally coupled to the base;
  - a second portion pivotally coupled to the base and spaced apart from the first portion; and
  - a third portion disposed between the first portion and the second portion;
  - the controller is disposed at least partially within the third portion of the handle;
- wherein:
  - the second portion of the handle extends parallel to the first portion of the handle;
  - the third portion of the handle extends orthogonal to the first portion of the handle and the second portion of the handle;
  - a display of the controller is located on the third portion of the handle;
- a first push button electrically connected to the controller and configured to set an operating parameter of the heat press is located on the first portion of the handle; and
- a second push button electrically connected to the controller and configured to set an additional operating parameter of the heat press is located on the second portion of the handle.

2. The heat press of claim 1, including a heater disposed within at least one of the lower platen and/or the upper platen, the heater electrically connected to the controller.

3. The heat press of claim 1, wherein manipulation of the handle causes the upper platen to move relative to the lower platen.

4. The heat press of claim 2, wherein the controller is configured to control at least one parameter of the heat press, the controller including:
- a viewing surface; and
- a display disposed on the viewing surface.

5. The heat press of claim 4, wherein the display is configured to show the at least one parameter of the heat press, and wherein the at least one parameter of the heat press includes a temperature of the heater and/or a timer.

6. The heat press of claim 4, wherein the controller includes at least one button configured to set the at least one parameter of the heat press.

7. The heat press of claim 4, wherein the controller includes a turn knob configured to set the at least one parameter of the heat press.

8. The heat press of claim 4, wherein manipulation of the handle causes the controller to move such that the display is continuously unobstructed.

9. The heat press of claim 1, including a heater disposed in the upper platen.

10. The heat press of claim 9, wherein the upper platen is coupled to the heater arm via an adjustment unit, and the adjustment unit is configured to move the upper platen relative to the heater arm.

11. The heat press of claim 1, wherein:

the base includes a first portion, a second portion, and third portion;

the second portion and the third portion extend from the first portion;

the second portion is spaced apart from the third portion; and the second portion and the third portion include substantially similar geometries.

12. The heat press of claim 11, wherein the heater arm includes a first portion and a second portion, the first portion of the heater arm is pivotally coupled to the second portion of the base and the second portion of the heater arm is pivotally coupled to the third portion of the base.

13. The heat press of claim 12, wherein the heat press includes:

a first shock connected to the second portion of the base and the first portion of the heater arm; and a second shock connect to the third portion of the base and the second portion of the heater arm.

14. The heat press of claim 13, wherein the first shock and the second shock are configured to dampen a movement of the heater.

15. A method of fabricating a heat press, comprising:

disposing a controller at least partially in a handle;

attaching the handle to a base;

attaching a heater arm to the base;

coupling a pressure link to the heater arm and the handle;

attaching a lower platen to the base; and coupling an upper platen to the heater arm;

wherein disposing the controller at least partially within the handle includes:

locating a first push button on a first portion of the handle, the first push button is electrically connected to the controller and is configured to set an operating parameter of the heat press;

locating a second push button on a second portion of the handle, the second push button is electrically connected to the controller and is configured to set an additional operating parameter of the heat press; and locating a display of the controller on a third portion of the handle.

16. The method of claim 15, including providing at least one of the upper platen and/or the lower platen with a heater, the heater electrically connected to the controller.

17. The method of claim 15, wherein a surface of the upper platen is separated from a surface of the lower platen in a first position, and the surface of the upper platen is in contact with the surface of the lower platen in a second position.

* * * * *